US011180994B2

(12) United States Patent
Heymann

(10) Patent No.: US 11,180,994 B2
(45) Date of Patent: Nov. 23, 2021

(54) REINFORCEMENT SYSTEM FOR THE CONCRETE LINING OF THE INNER SHELL OF A TUNNEL CONSTRUCTION

(71) Applicant: BAG Bauartikel GmbH, Sprendlingen (DE)

(72) Inventor: Martin Heymann, Erbes-Büdesheim (DE)

(73) Assignee: BAG BAUARTIKEL GMBH, Sprendlingen (DE)

( * ) Notice: Subject to any disclaimer, the term of this patent is extended or adjusted under 35 U.S.C. 154(b) by 0 days.

(21) Appl. No.: 16/645,391

(22) PCT Filed: Aug. 24, 2018

(86) PCT No.: PCT/DE2018/100734
§ 371 (c)(1),
(2) Date: Mar. 6, 2020

(87) PCT Pub. No.: WO2019/047997
PCT Pub. Date: Mar. 14, 2019

(65) Prior Publication Data

US 2020/0284147 A1 Sep. 10, 2020

(30) Foreign Application Priority Data

Sep. 7, 2017 (DE) ..... 10 2017 120 635.3
Sep. 25, 2017 (DE) ..... 20 2017 105 802.6
(Continued)

(51) Int. Cl.
*E21D 11/18* (2006.01)
*E21D 11/08* (2006.01)
(Continued)

(52) U.S. Cl.
CPC ..... *E21D 11/186* (2013.01); *E21D 11/08* (2013.01); *E21D 11/107* (2013.01); *E21D 11/183* (2013.01); *E21D 11/22* (2013.01)

(58) Field of Classification Search
CPC ..... E21D 11/107; E21D 11/186; E21D 11/08; E21D 11/183; E21D 11/22
See application file for complete search history.

(56) References Cited

U.S. PATENT DOCUMENTS 3,858,400 A * 1/1975 Bernold ..... E21D 11/107 405/150.2
4,112,694 A * 9/1978 Gruber ..... E21D 11/152 405/150.2
(Continued)

FOREIGN PATENT DOCUMENTS

AT 258837 B 12/1967
CH 674546 A5 6/1990
(Continued)

OTHER PUBLICATIONS

International Search Report from corresponding International Application No. PCT/DE2018/100734, dated Dec. 20, 2018, pp. 1-5, European Patent Office, Rijswijk, Netherlands.

*Primary Examiner* — Carib A Oquendo
(74) *Attorney, Agent, or Firm* — Hauptman Ham, LLP

(57) ABSTRACT

A self-supporting reinforcement system for the concrete lining of the inner shell of a tunnel construction. At least one object is that of supporting the outer shell or rock wall of a tunnel construction. According to an embodiment of the invention, this is achieved by tension brackets or tension rings, formed from one or more bracket segments made of individual reinforcing steel bars. M-shaped tensioning support bodies having a connecting region to the tension brackets, and support arms for the supporting bracing, establishing the spacing with respect to an outer shell or rock
(Continued)

Figure 1:
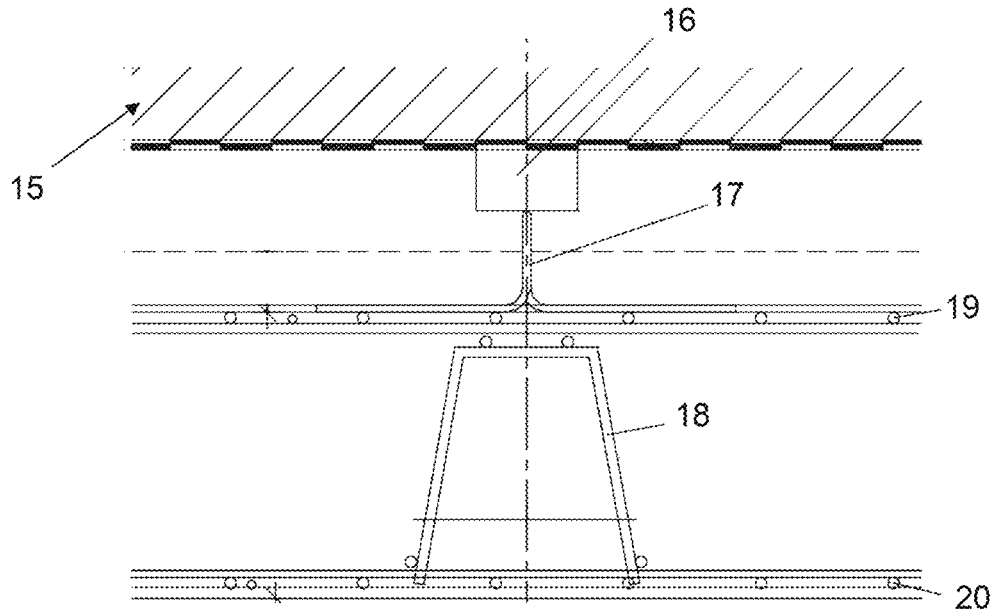

wall, of the bracket and spacers on the tensioning support bodies and between the outer layer and an inner layer of the reinforcement.

20 Claims, 6 Drawing Sheets

(30) Foreign Application Priority Data

Nov. 2, 2017 (DE) ..... 10 2017 125 624.5
Apr. 23, 2018 (DE) ..... 20 2018 102 249.0

(51) Int. Cl.
*E21D 11/10* (2006.01)
*E21D 11/22* (2006.01)

(56) References Cited

U.S. PATENT DOCUMENTS 4,239,416 A * 12/1980 Borca ..... B65G 5/00 220/62.21
5,180,253 A * 1/1993 Siegfried ..... E04C 5/08 405/146
5,470,178 A * 11/1995 Weholt ..... E21D 11/38 405/150.1
2020/0109552 A1* 4/2020 Tucker ..... E04B 1/3211

FOREIGN PATENT DOCUMENTS

| | | | |
|---|---|---|---|
| CN | 102733827 | * | 10/2012 |
| DE | 1533746 B | | 9/1969 |
| DE | 202009009718 | * | 1/2011 |
| JP | 4323500 | * | 11/1992 |
| JP | 2009144362 | * | 7/2009 |
| JP | 2013087514 | * | 5/2013 |

* cited by examiner

Fig. 7:
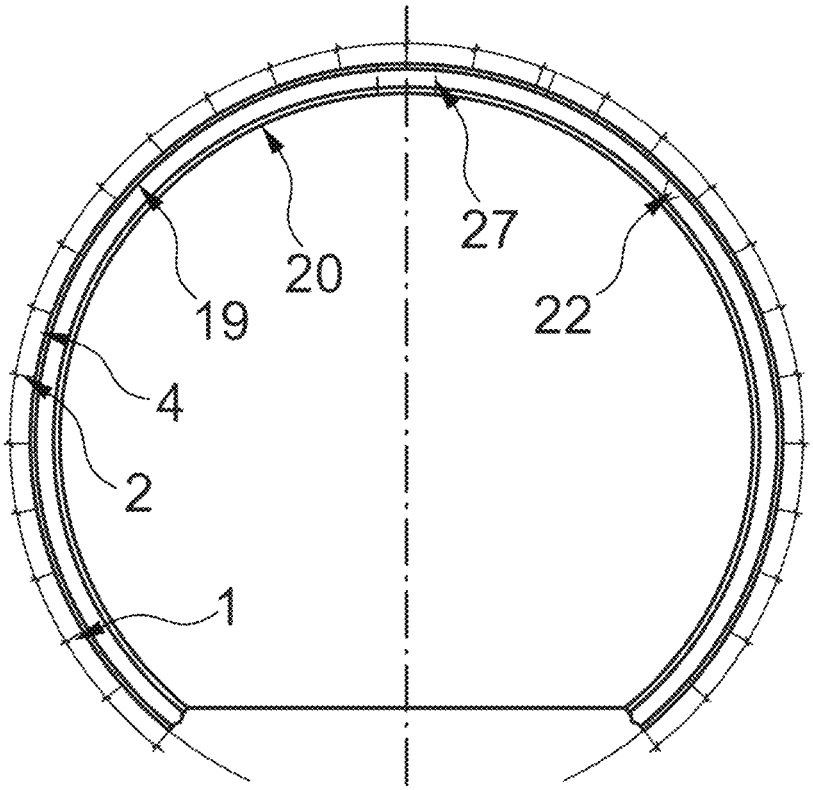
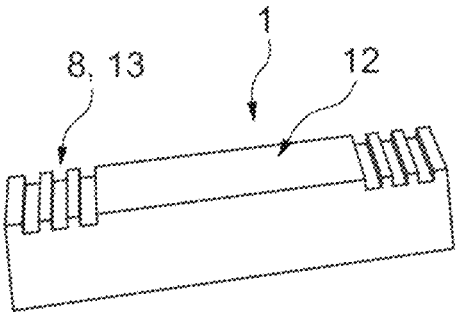
Fig. 8
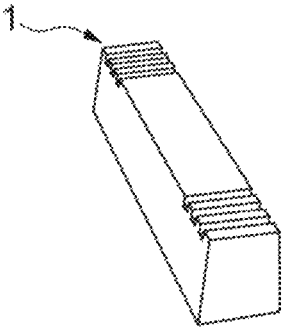
Fig. 9
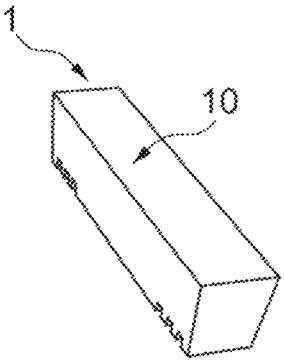
Fig. 10

REINFORCEMENT SYSTEM FOR THE CONCRETE LINING OF THE INNER SHELL OF A TUNNEL CONSTRUCTION

RELATED APPLICATIONS

The present application is a National Phase of International Application Number PCT/DE2018/100734, filed Aug. 24, 2018, and claims the priority of German Application No. 10 2017 120 635.3, filed Sep. 7, 2017, German Application No. 10 2017 125 624.5, filed Nov. 2, 2017, German Application No. 20 2017 105 802.6, filed Sep. 25, 2017, and German Application No. 20 2018 102 249.0, filed Apr. 23, 2018.

The invention relates to a reinforcement system for the concrete lining of the inner shell of a tunnel construction according to the features in claim 1.

In the case of tunnels excavated through mountains, the shotcrete technique (New Austrian Tunnel Construction Method NATM) results, as a rule, in a two-shell design with an outer shell of shotcrete and an inner shell of cast in-situ concrete.

In this connection, the shotcrete is applied, as a rule, directly after the breakout for the temporary safeguarding of the mountain. In addition, safeguarding with steel arches, anchors and reinforcement steel meshes can be necessary.

The subsequently introduced inner shell of cast in-situ concrete serves thereafter for the permanent lining of the tunnel and is, as a rule, concreted on tunnel formwork carriages. Said shell comprises, in this connection, thicknesses of between 30 cm and 60 cm but can also be realized in a considerably thicker manner. The section lengths in which the inner shell is concreted are in the majority of cases between approximately 8 m and 12.5 m. The inner shell can be realized in a reinforced or unreinforced manner.

The present invention relates to the lining of tunnel constructions where the inner shell is realized in a reinforced manner.

A sealing sheet, which protects the inner shell from possible aggressive mountain waters and also the interior from the ingress of mountain waters, is often installed between the outer and inner shells of a tunnel construction. In order not to damage said sealing sheet between the outer and inner shells, the arched reinforcement of the inner shell, as a rule, must not be fixed to the outer shell. This makes self-supporting arched reinforcement necessary, consisting of outer and inner reinforced steel meshes and bar steel secondary reinforcement with load-bearing arches lying in between them.

A reinforcement carriage is used as scaffold carriage for the installation of the arched reinforcement of the inner shell. The arched reinforcement stands, in this connection, on the precast concrete floor which has been set up beforehand. An up-to-date used arched reinforcement consists, in this connection, of an outer layer of reinforcement steel meshes, the load-bearing arches, an inner layer of reinforcement steel meshes and spacers. Said structure, as a rule, is fixedly connected, that is to say is bound together by means of wire such that a fixedly connected support structure of meshes and rods is created.

For this purpose, with support of the reinforcement carriage, first of all reinforcement steel meshes are mounted for erecting an outer rock face-side reinforcement layer, firstly reinforcement steel meshes supported by stays arranged on the reinforcement carriage being mounted in the ring direction and secondly reinforcement steel meshes being mounted in the longitudinal direction. The load-bearing arches are then placed in front of said outer, rock face-side layer of the reinforcement, also with the support of the reinforcement carriage, so that said elements are held on the rock face side by the load-bearing arches.

Spacers are arranged between said outer layer of the reinforcement and the outer shell or a seal arranged on the outer shell in order to ensure the necessary minimum concrete coverage of the installed reinforced concrete parts of, for example, approximately 6 cm. Approximately U-shaped brackets, which comprise, for example, a cross section of 10 mm, are inserted, as a rule, into said spacers. Said iron brackets are angled at their free ends such that a desired distance between the outer layer of the reinforcement arranged on the rock face side and the outer shell itself is able to be set as a result of interaction between spacer and said U-shaped iron bracket.

An inner layer of reinforcement steel meshes is then arranged on the set load-bearing arches toward the inside of the inner shell. The distance between the outer layer and the inner layer of the reinforcement is consequently determined by the set load-bearing arches which are arranged between said layers. Here too, just as already in the case of the outer layer, first of all the ring direction, as a rule, is provided with reinforcement steel meshes in order then to arrange the reinforcement steel meshes in the longitudinal direction as the final step. Subsequently mounted spacers on the outside inner layer then point toward the formwork of the inner shell, which is moved with a formwork carriage to the self-supporting reinforcement prior to concreting. Said spacers which point toward the formwork ensure the necessary minimum concrete coverage of the installed reinforced concrete parts as already described beforehand.

The self-supporting design which is stabilized by load-bearing arches is thus constructed in blocks, i.e. the reinforcement supports itself and is supported on the walls or the side walls of the tunnel against the rock face wall. Additional support in the roof region is consequently not necessary.

The reinforcement work in the tunnel has to run so rapidly that there is always a sufficient forward motion prior to the concrete work.

Said installation sequence, however, has some disadvantages. On the one hand, the load-bearing arches to be installed are prefabricated components which have to have self-supporting stability. This requires a cross section which enables said stability, in the representation shown in FIG. 1 as an example, an approximately U-shaped cross section for example. This is consequently the most expensive component used in the currently used reinforcement system having a high material weight, which is reflected negatively in a corresponding manner in the costs for the reinforcement to be provided.

In addition, it is disadvantageous that the described assembly sequence assumes the labor force working on site has technical experience and skill which is reflected once again in higher costs. By implication, in the worst case scenario inadequately carried out reinforcement work can also occur with labor forces with a lack of technical experience and skill. In addition, the time factor of said assembly sequence is also high, which has a negative effect on the construction progress.

It is disadvantageous, in particular, that said basic construction can only be installed if it is dimensionally accurate. Once the load-bearing arches have been set up and the reinforcement steel meshes attached on the inside, as a rule the reinforcement constructions sags at least a little as soon as it is released from the reinforcement carriage. A desired defined installation of the reinforcement for the inner shell is thus only possible in a limited manner.

AT 362 739 B discloses an arch segment for a lining arch of underground tunnels or sections which comprises a lattice girder section and a sliding profile section connected at the end of the lattice girder section. Said arch segments are to be connected to form a lining frame which is closed per se.

Through DE 1 237 160 A, a butt joint between truss girders, which serve as reinforcement of a tunnel cladding produced from concrete, ranks as the prior art. The truss girders are lattice girder sections and are produced from rods. Profile sections are fastened between the upper run and the lower run by welding at the ends of the truss girders and are tightly connected together by means of a pair of plates and screws and/or wedges.

A flexible composite lining is disclosed in DE 39 27 446 C1. A shotcrete layer on the wall of the rock face surrounding the tunnel or the section and a plurality of lining frames which are arranged in the longitudinal direction of the underground area and are produced from lining segments, which are connected so as to be flexibly insertable according to the rock face mass convergence, and a concrete backfill between the shotcrete layer and the lining frames are part of the composite lining. The lining segments are connected by means of clips or similar connecting means. Where applicable, the concrete backfill extends with lagging mats along the underground area. Bolting elements, which are realized as crimping elements which can be squeezed together at least in their transverse direction under the influence of the rock face pressure, are situated between adjacent lining frames.

Publication DE 20 2006 003 288 U1 discloses a load-bearing arch for stabilizing the shotcrete lining of a tunnel which consists of multiple steel rope belts which are connected together by struts, the struts being formed from bent steel parts of one or multiple different shapes which are connected to the steel rope belts by welded connections, the shape being open, that is to say it does not comprise any closed curved line and does comprise at least three straight part regions which merge into one another at their connecting point in a bending radius at an angle of between approximately 45° and 135°. As a result, the load-bearing arch is to be less expensive to produce and at the same time can be better adapted to the tunnel wall.

Against said background, the object of the present invention is to create a reinforcement system for the concrete lining of the inner shell of a tunnel construction which provides a cheaper and structurally simplified alternative to known load-bearing arch systems. The installation of the reinforcement system overall is to be effected, in this connection, in a dimensionally accurate and documentable manner, at the same time the work on site being made easier and installation mistakes being reduced.

This is achieved by the reinforcement system for the concrete lining of the inner shell of a tunnel construction according to at least one embodiment of the instant application.

Advantageous further developments and designs of the invention are the object of at least one embodiment of the instant application.

At least one embodiment of the instant application relates to a method for installing the reinforcement system.

The basic inventive concept, in this connection, is in the connection between a structurally simplified tensioning arch or tensioning ring and a tensioning support body and spacer elements which support and align said tensioning arch or tensioning ring by means of the tensioning support bodies with spacers on the outer shell of the tunnel wall. The inventive reinforcement system differs fundamentally, in this connection, from the previous approach as a result of the assembly sequence which is modified for reasons of design, which also affects the working process and the cost of material.

In contrast to the arrangement of the self-supporting load-bearing arches between the outer and inner reinforcement layers in the described system currently prevailing, the inventive reinforcement system provides, as first assembly step, positioning the tensioning arch or tensioning ring, for which reason, guided on the reinforcement carriage, said tensioning arch or tensioning ring is tensioned in a self-supporting manner on the outer shell as a result of the positioning of the spacers with tensioning support bodies. The tensioning arches or tensioning rings arranged side by side in parallel in this way consequently form the substructure for the first outer layer of reinforcement steel meshes which are fastened on said substructure of the tensioning arches or tensioning rings, for example, firstly in the ring direction and then in the longitudinal direction.

In contrast to the disclosed arrangement, spacers are then arranged on said outer layer which, once again, set the spacing to the inner layer of the reinforcement meshes. A load-bearing arch in the sense of the prior art between the outer layer and the inner layer is consequently dropped completely, which leads to a considerable amount of saving potential. At the same time, however, the assembly of the outer and inner reinforcement layers once the tensioning arches or tensioning rings have been positioned is also greatly simplified compared to the assembly sequence of the known reinforcement system, which results in the desired simplifications to the assembly and thus, as a result, in a reduction in the risk of installation errors in particular as a result of an inexperienced labor force.

Said simplified tensioning arches or tensioning rings can be realized, in this connection, in an advantageous design as rods in the form of arch segments which are connected on site to form a lining arch of the necessary size in dependence on the tunnel cross section and are arranged on the outer shell of the tunnel wall by means of the tensioning support bodies and spacer elements according to the invention.

In principle, however, the cross section of the simplified arch elements in different designs is expedient as, first and foremost, according to the invention, said arch elements are realized in a structurally simple manner and consequently can be used as cost-efficient components in contrast to the cost-intensive self-supporting load-bearing arches. Consequently, the focus is in the question of the sturdy support of the simplified arch elements on the outer shell of the tunnel wall as substructure for the reinforcement.

Exemplary designs provide two or four arch segments which are welded together on each free end, connected in the overlapping region by cable clamps or are inserted into a connecting sleeve and are secured here, for example, by screws and thus are connected to form a load-bearing arch which, in its length and shape, is realized corresponding to the reinforcing cross section of the tunnel construction. A combination of various of the aforenamed connecting means can also be useful depending on the application.

A substantial improvement compared to the known reinforcement system, in this connection, is that the tensioning arches or rings are not just held and positioned by the tensioning support bodies but are also additionally tensioned by a final expansion, as a result of which it is possible for the installation to achieve a high level of strength and also dimensional stability in spite of the advantageously simple design of said basic structure.

A possible design provides arranging an overlapping portion, which serves to introduce a re-tensioning, between at least two of the arch segments in the tensioning arch or tensioning ring which makes it possible, after the installation of the tensioning arch or tensioning ring and a release through the support elements of the reinforcement carriage, to react to a possible tension loss or a slight drop in the roof region. The tensioning arch or tensioning ring is held together, for this purpose, in the overlapping region of two arch segments for example by angled hooks on the free ends of adjacent arch segments, with which a tensioning device cooperates. Said angled hooks can be formed by the free ends themselves and are pulled toward one another by the tensioning device, the tensioning arch or tensioning ring is consequently expanded and the tension in the tensioning arch or tensioning ring is thus raised again overall, as a result of which the desired arch progression, for example in the recessed roof region, is able to be re-adjusted again. Only then is the tensioning arch or tensioning ring fixedly connected finally in the overlapping region by the already named means, for example cable clamps or welding.

The significantly improved dimensional stability of the reinforcement system according to the invention is consequently generated from the interaction between the prefabricated tensioning arch or tensioning ring and the tensioning support bodies which are adapted individually to their respective tensioning position on the arch or ring by being cut to length or angled. The arch or ring is thus tensioned in the defined position, even in the case of very strongly deviating spacings to, for example, the outer shell which are frequently very irregular, as said deviations are able to be balanced out by the length-adapted tensioning support bodies. The final tensioning as a result of the expansion of the arch or ring finally brings about secure fixing in said dimensionally stable installation position.

In this connection, it is provided according to the invention that when said tensioning arches or tensioning rings are inserted in the tunnel lining, the spacings between them can be identical or greater than is the case with the previous load-bearing arch systems. This can accordingly result in a further advantage as fewer tensioning arches or tensioning rings are necessary per section (block). As a result of the connection between the tensioning support bodies and the spacer bodies which abut against the outer shell, said tensioning arches or tensioning rings are also supported in a self-supporting manner on the outer shell even though they do not comprise a spatial framework-like cross section. Stabilizing is effected via the tensioning with the tensioning support bodies.

In the case of the method for installing said reinforcement system, it is provided to install said reinforcement system in a known manner with support provided by reinforcement carriages as self-supporting reinforcement. The spacers with inserted tensioning support bodies are then, for example, first of all lightly angled between the tensioning arch or tensioning ring and the outer shell and are then pulled manually into their installation position, as a result of which the tensioning support bodies extend approximately at right angles to the progression of the tensioning arch or tensioning ring in said connecting region and are tensioned between the outer shell and the tensioning arch or tensioning ring. As the outer shell is realized, as a rule, in an irregular manner, it is necessary, for this reason, to shorten the tensioning support bodies to a dimension that is necessary for the tensioning.

As an alternative to this, the insertion of the tensioning support bodies and spacers can also be supported as a result of the tensioning arch or tensioning ring, held on the reinforcement carriage, being pulled by machine to a suitable spacing from the support surface of the outer shell in opposition to the internal tension of the tensioning arch or tensioning ring for the respective insertion of the tensioning support bodies. Once the tensioning support bodies and spacers have been positioned, said tension is released so that the tensioning arch or tensioning ring is pressed onto the tensioning support bodies at said point as a result of the internal tension thereof, as a result of which the tensioning to the outer shell is obtained.

The operation of tensioning by means of tensioning support bodies and spacers is effected over the entire circumference of the load-bearing arch at defined intervals which ensure a secure self-supporting state of the tensioning arch or tensioning ring. Since in the case of the tensioning arch, the floor, as the contact surface of the tensioning arch, is already present as precast concrete, it serves as support for the free ends of the tensioning arch, as a result of which the position and tension thereof with reference to the outer shell is ensured with defined dimensioning. In the case of the tensioning ring, it is tensioned over its entire circumference at defined intervals with tensioning support bodies, that is to say also on the floor as here the tensioning ring is also part of the reinforcement of the floor.

It is necessary against said background, as stated, to cut the tensioning support bodies to length on site, to the required dimension that is necessary for the tensioning and support. The present cross section of the tunnel construction is surveyed, as a rule, on site and the cutting to length of the tensioning support bodies is then effected corresponding to the dimension removed. It is nevertheless provided according to the invention, in this connection, to stock tensioning support bodies in different dimensions in order to be able to keep the portion to be cut to length always small.

In order to arrange the tensioning arches or tensioning rings on the outer shell of the tunnel construction, in an advantageous realization of the invention, the rod, for example, is supported against the outer shell and the web possibly arranged thereon by a connection produced between a spacer, which is positioned directly on the rock face wall, and a, for example M-shaped, bracket as tensioning support body. The tensioning arch or tensioning ring is placed into the recess-like indentation realized here between the laterally angled support arms of the M-shaped bracket which engage in the spacer and is tensioned or clamped against the outer shell of the wall of the tunnel in the manner described beforehand.

The tensioning support bodies in the form of an M-shaped bracket are simply one possible design. An alternative design provides a tensioning support body which cooperates by way of a fastening means, for example a clamping ring, with, for example, the rod and holds it. The support arms of the tensioning support body proceed from the fastening means toward the spacer receiving them or toward the spacers receiving them insofar as a separate spacer is assigned to each support arm.

It is necessary, for this reason, to design a spacer with which the tensioning support body, for example the M-bracket, is able to cooperate or in which the M-bracket is able to engage by way of its free end which points to the outer shell. Various structural designs are possible for this.

Indentations are expediently arranged in the spacer. These can be realized in a borehole-like manner so that the free ends of the tensioning support body, for example of the M-bracket, can be inserted directly into said holes. However, it is also possible for slots or projections to be arranged in the spacer so that the M-brackets comprise an angulation at the lower end with which they engage in said slots or abut against the projections. Said releasable connection between spacer and tensioning support body can be realized, in principle, in a variable manner.

An advantage of the arrangement of the tensioning support body on the spacer with angulations on the support arms thereof is that, in this way, the addressed necessary length adaptation of the tensioning support body to the respectively present spacing between outer shell and tensioning arch or tensioning ring is not achievable as a result of cutting the rod to length but solely by the angulation thereof.

As an alternative to this, the spacer can comprise connecting means which have been inserted, for example, into a concrete spacer during the production process, for example plastic or metal receiving means which are recessed or project out of the top side of the spacer pointing to the reinforcement.

In addition, each support arm of the tensioning support body can engage in its own spacer or can be connected to such a spacer. In this connection, it must be ensured that the support arms of the tensioning support body are not unintentionally expanded when it is tensioned with the tensioning arch or tensioning ring, which could result in a loss of tension in the arrangement of the tensioning arch or tensioning ring.

A design of the spacer can comprise a protective support, for example a type of geotextile, on its bottom side which points to the outer shell and rests on a web so that the web is not damaged by the spacer edging. Elongated rod-shaped spacers or also individual round spacers can be fastened to the M-brackets in this connection. Flat support surfaces are preferred, in this connection, in order not to load the web in a punctiform manner.

The method for installing the reinforcement system according to the invention provides that the tensioning arches or tensioning rings in the form of the tunnel cross section to be reinforced are mounted such that they comprise a defined installation position with reference to the first external outer shell of the reinforcement, said tensioning arches or tensioning rings are guided on a reinforcement carriage and are placed in the tunnel cross section. A method solution then provides that the tensioning arches or tensioning rings are pulled into a holding position with respect to the reinforcement carriage for the insertion of the tensioning support bodies between load-bearing arches and outer shell and once the tensioning support bodies have been positioned in the connecting regions thereof are inserted by being pulled out of the holding position, as a result of which the tensioning arches or tensioning rings engage in the connecting regions of the tensioning support bodies and are tensioned and supported against the outer shell of the tunnel construction by means of the tensioning support bodies. Simply holding the tensioning arches or tensioning rings on the reinforcement carriage is provided as an alternative to this, the clamping taking place as a result of manually inserting the combination of spacer and tensioning support body.

In order to determine the desired installation position of the tensioning arch and to secure it against displacement when inserting the tensioning support bodies, the tensioning arches are mounted in a defined measured arch length and are set up on the precast concrete floor of the tunnel construction or in holes which are arranged in said already concreted floor. The floor serves, in this connection, as a support for the erected tensioning arches, the arrangement in prefabricated holes preventing the tensioning arches slipping out of the construction joint between floor and arch.

For the further stabilization of the installed reinforcement system, the tensioning arches or tensioning rings, once tensioned by the tensioning support bodies, can be fastened by fastening means or a welded connection in the connecting region of the tensioning support bodies.

An alternative arrangement, which provides that the tensioning arches or tensioning rings are installed in pairs in parallel and are fixedly connected by means of cross-connectors, also has a stabilizing effect. The tensioning arches or tensioning rings connected in pairs in this manner form a very sturdy support for the further reinforcement means.

In order to adapt the tensioning support bodies precisely to the conditions on site, it is expedient, as a rule, for the tensioning support bodies to be cut to the necessary length or adjusted on site. For this purpose, the specific dimensions are taken on site and are taken as a basis for the length adaptation of the tensioning support bodies. There can be special cases in which such adaptation measures are not necessary on account of an outer shell which is already realized uniformly, for example in the case of an arrangement of an inner shell on a lining segment.

Figure 2:
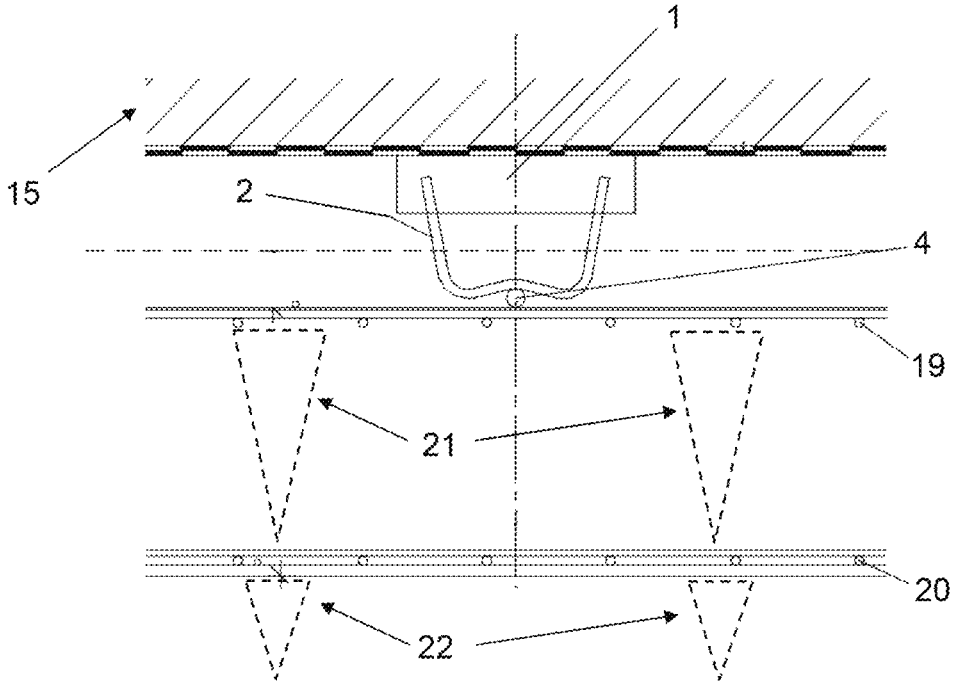
Figure 3:
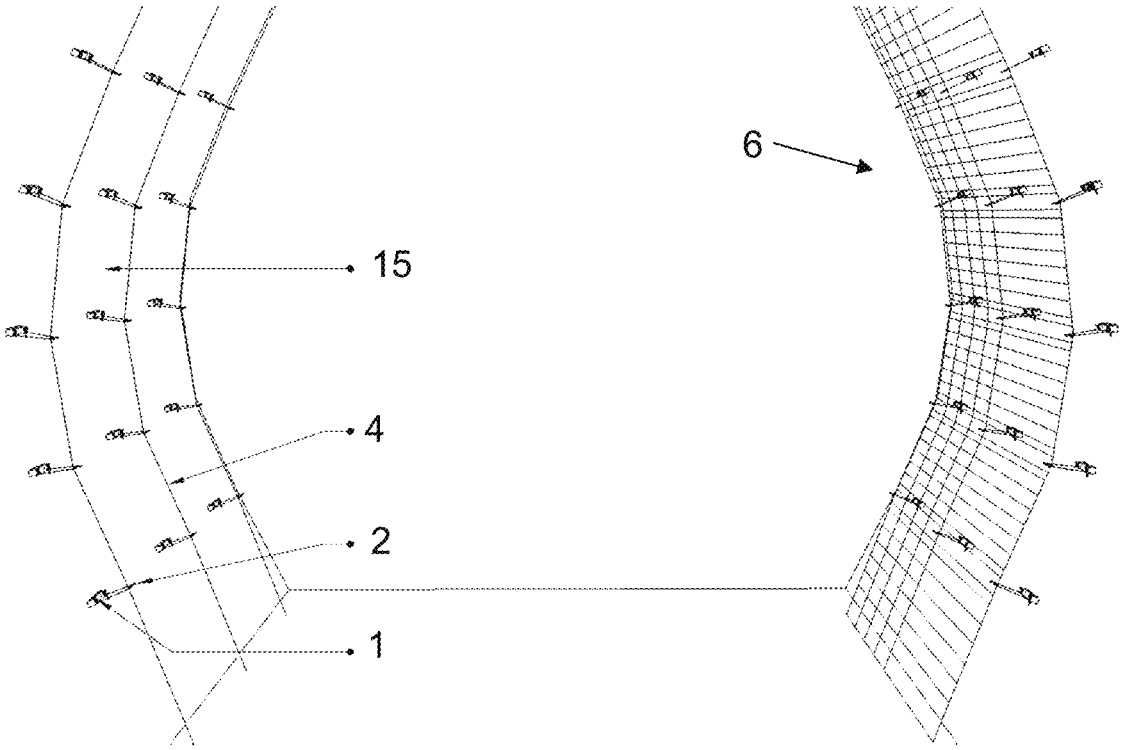
Figure 4:
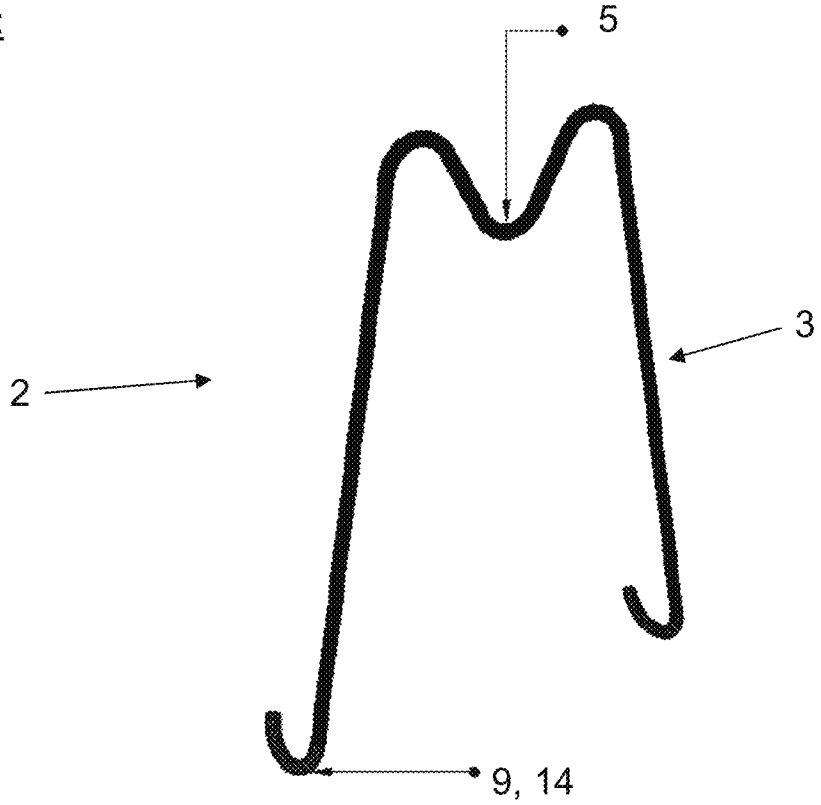
Figure 5:
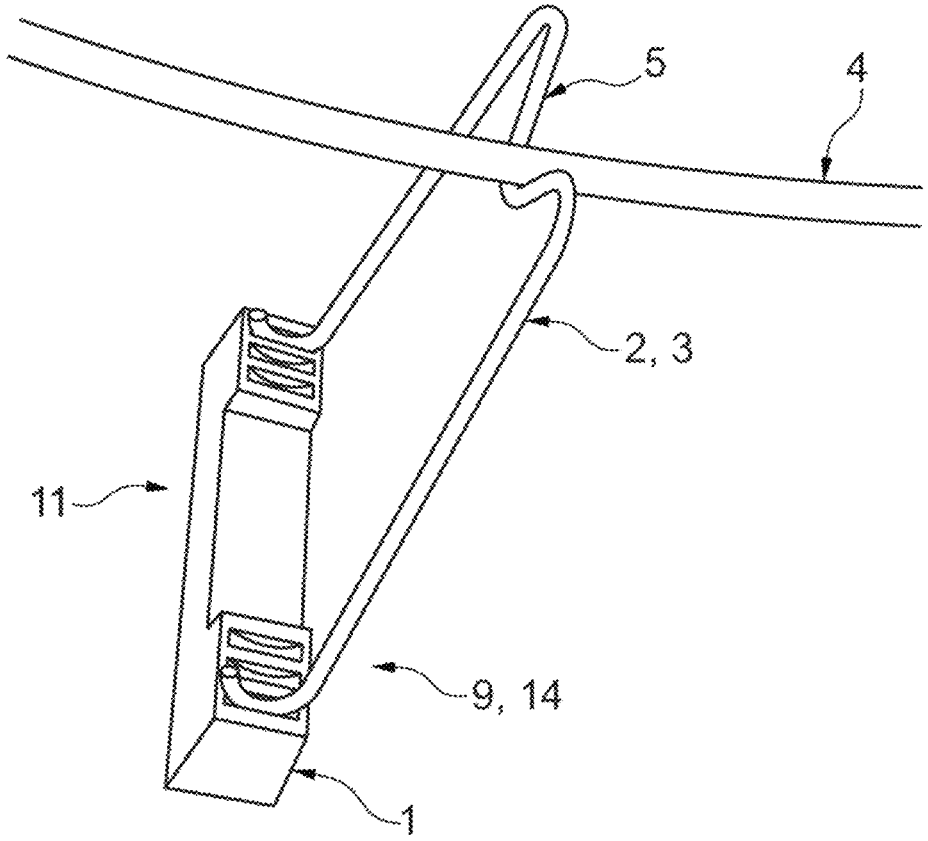
Figure 6:
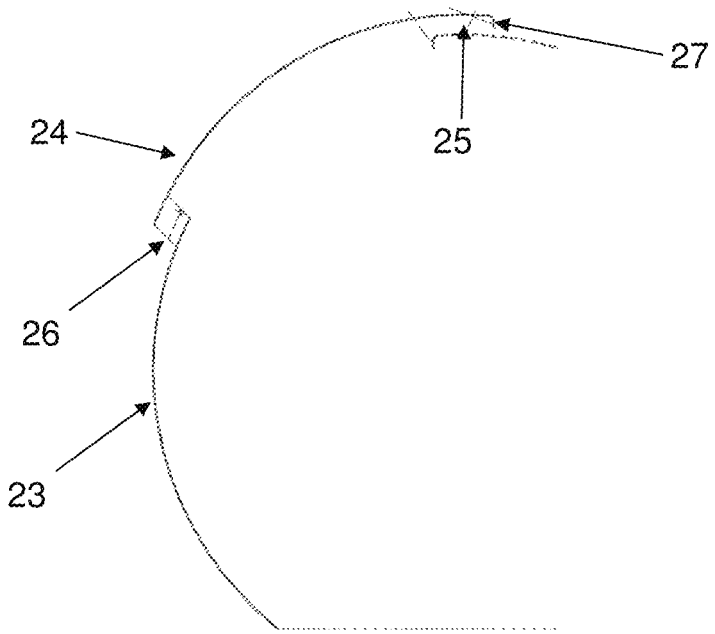
Figure 11:
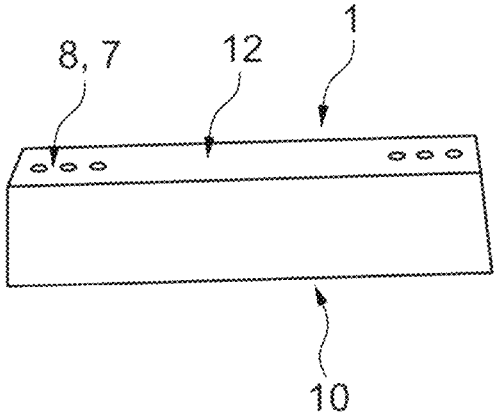
Figure 12:
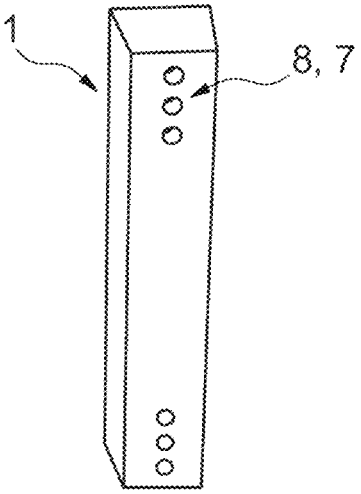
Figure 13:
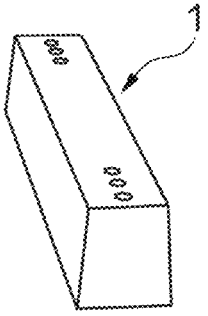
Figure 14:
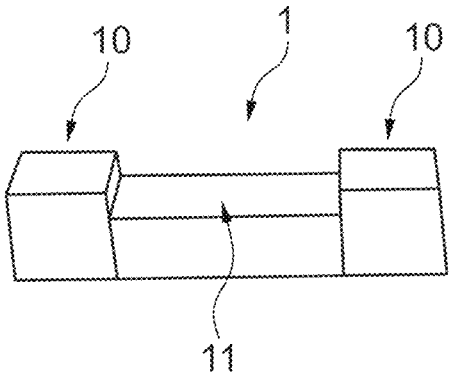
Figure 15:
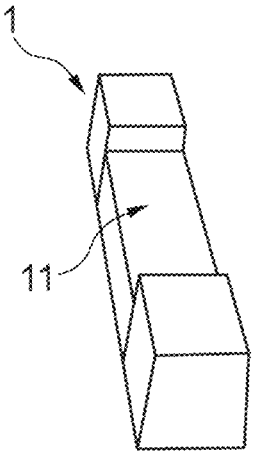

The invention is to be explained in more detail below by way of drawings, in which FIG. 1 shows a section through a reinforcement system according to the prior art, FIG. 2 shows a section through the reinforcement system according to the invention, FIG. 3 shows the design of the reinforcement system as an example, including the spacer 1 with M-bracket 2 and tensioning arch 4, FIG. 4 shows a tensioning support body 2 according to the invention in the form of an M-shaped bracket and FIG. 5 shows a perspective view of a view of a detail of the combination of spacer 1, tensioning support body 2 and tensioning arch 4, FIG. 6 shows a part region of the tensioning arch 4 consisting of 2 part regions, FIG. 7 shows a side view of a fully installed tensioning arch 4 with a view of the detail and FIGS. 8 to 17 show various structural designs of the spacer 1 according to the invention.

FIG. 1 clarifies the design of a reinforcement of the inner shell as has been explained already in the introduction to the description, including a spacer 16 with an inserted position-securing-body 17, against which the outer layer 19 of the reinforcement steel meshes abuts and which is fixed in its position with respect to the outer shell 15 by the positioned load-bearing arch 18. The inner layer 20 of the reinforcement, which ultimately bears spacers to the formwork which are not shown graphically here, is fastened on the load-bearing arch 18 which determines the spacing between the reinforcement layers.

FIG. 2 underlines the difference to the previous solution. The most marked difference is the lack of the load-bearing arch 18 between the inner and outer reinforcement layers 19 and 20 as these are simply spaced apart by spacers 21. Said design is possible as the self-supporting component in the system is the combination of spacer 1 with tensioning support body 2 and tensioning arch 4 or tensioning ring which is arranged and tensioned first of all on the outer shell 15.

As a result of the arrangement of the outer layer 19 of the reinforcement steel meshes, said arrangement already achieves a high degree of stability so that it is able to carry the further arrangement of the spacers 21 and the inner layer 20 of the reinforcement steel meshes. The spacers 22, which point to the formwork on the inner layer 20, serve for ensuring the minimum concrete coverage of the installed reinforced concrete parts to the formwork.

FIG. 3 shows a schematic representation of an exemplary arrangement of the reinforcement system according to the invention in a tunnel construction. The right-hand half of the image here shows the reinforcement with reinforcement steel meshes which are arranged on the tensioning arches 4 and are fastened on the reinforcement substructure according to the invention.

The left-hand half of the image shows the reinforcement system according to the invention prior to the cladding with the reinforcement steel meshes. It can be seen on said page that three basic components are crucial to said reinforcement substructure, as are shown in more detail in FIG. 5. This is, on the one hand, a spacer 1 which rests directly on the tunnel wall to be reinforced or on the outer shell of the tunnel construction and the web 15 arranged here if applicable. In this connection, this is, for example, a cast concrete body which comprises special receiving means 8 as connecting regions for the arrangement of the tensioning support body 2. Said tensioning support body 2 is connected to the spacer 1, for example is inserted or clamped in corresponding receiving means 8 of the spacer 1.

The tensioning support body 2, in this connection, comprises at least two support arms 3 (FIG. 4) which engage in the spacer 1 and extend to the supporting tensioning arch 4 or tensioning ring. In said exemplary design, the tensioning arch 4 or tensioning ring consequently engages in a connecting region 5 realized between the support arms 3 and consequently fixes the connection of tensioning support body and spacer in its proper position. It is significant, in this connection, that the tensioning arch or tensioning ring is supported in a tensioned manner on the tunnel wall or the outer shell of the tunnel construction in the tunnel cross section via the tensioning support bodies 2 and consequently is realized so as to be self-supporting.

In the design shown, the tensioning arch 4 or tensioning ring is realized from individual rods, which is even clearer in FIGS. 5 and 6. As an alternative to this, it is possible to use, on the one hand, other cross sections of the tensioning arch 4 or tensioning ring and, on the other hand, also, for example, two tensioning arches 4 or tensioning rings which are arranged side by side and are connected together by means of spacers as connecting bodies, for example inserted rod sections. It can also be achieved in this manner that said tensioning arch 4 or tensioning ring formed from two parallel rods already comprises its own stand which can then be tensioned against the tunnel wall by inserting the tensioning support body 2 and spacer 1. The tensioning support body 2 then comprises a correspondingly formed connecting region 5 to the parallel tensioning arches or tensioning rings.

The right-hand side of the image then shows, as already stated, that the reinforcement system according to the invention is connected to reinforcement steel meshes 6. Said reinforcement steel meshes 6 are fastened on the previously positioned tensioning arches 4 or tensioning rings with corresponding fastening means, for example wires. The overall reinforcement structure is then created in this way, consisting of the inventive reinforcement system which, on the one hand, forms the basis for the reinforcement steel meshes, on the other hand, however, also determines the distance thereof to the outer shell or to the web 15 arranged on the outer shell.

FIG. 4 then shows a possible tensioning support body 2 in a design as an M-shaped tensioning support body 2. The advantage of this is that the M-shaped tensioning support body 2 comprises a centrally arranged connecting region 5 which is realized as an indentation between the two laterally branching support arms 3. In this connection, the support arms 3 extend outward at an angle from the tensioning arch 4 or tensioning ring, as a result of which the supporting function is ensured. This is significant as the central task of said tensioning support body 2, along with tensioning, is also support on the outer shell. During tensioning, the tensioning arch 4 or tensioning ring looks for possible tension relief by deflecting in the longitudinal direction of the tunnel construction to be reinforced. Said tilting is consequently to be urgently avoided in order to achieve the desired tension and the resultant self-supporting design. The support arms 3 on the tensioning support body 2 turning out to the side brings about in an inventive manner precisely said lateral support against the tensioning arch 4 or tensioning ring breaking out to the side.

On its free lower ends 9 which point to the spacer 1, said exemplary tensioning support body 2 is realized in an angled manner in the present design, as a result of which it is able to be inserted into corresponding or slot-like receiving means 8 in the spacer 1, as shown in FIG. 5. In this connection, it is additionally provided that as a result of the internal tension of the tensioning support body 2, insertion into the slot-like receiving means 8 in the spacer 1 can also take place under certain internal tension, as a result of which a more secure arrangement of the tensioning support body 2 in the receiving means 8 in the spacer 1 is ensured.

In addition, creating said angulations 14 makes it possible once on site to carry out, in a precisely fitting manner, the generally necessary adaptation of the length of the support arms 3 with respect to the given installation position for achieving the necessary tension to the tensioning arch 4 or tensioning ring. This provides an alternative to adapting the support arms 3 by shortening said support arms 3.

FIG. 5 shows an exemplary detailed perspective view of the arrangement according to the invention of said structural components of the reinforcement system.

A spacer 1, which is realized in the representation as a bar-like spacer 1 with receiving means 8, 13 arranged in a slot-like manner on the top side thereof, is placed, in this connection, on a web 15. In the central region of its top side, the spacer comprises, in this connection, another continuous indentation 11. Both said design of the receiving means 8 and of the indentation 11 are to be understood simply as exemplary designs, which also becomes clear as a result of the further designs in the following figures.

A tensioning support body 2 is connected to the spacer 1 when it engages in the receiving means 8. The tensioning support body 2 comprises, for this reason, on the free ends 9 of the support arms 3, angulations 14 which engage in the slot-like receiving means 8, 13 of the spacer 1 and are thus connected thereto and supported thereon.

The connecting region 5, in which the tensioning arch 4 or tensioning ring is placed, is arranged between the support arms 3 of the tensioning support body 2 as an indentation. In the design shown, no special connection between the tensioning arch 4 or tensioning ring and the connecting region 5 takes place in this connection. No connecting means is arranged in said connecting region 5, which, however, can be entirely reasonable in the case of other designs of said tensioning support body 2. The tensioning arch 4 or tensioning ring, in this connection, comprises an arched basic form in order to imitate the curved progression of the tunnel cross section in a corresponding manner.

FIG. 6 shows a cutout of two arch segments 23, 24 in the case of a tensioning arch 4 which is composed of 4 segments, that is to say half the tensioning arch 4. The connecting region 26, which is producible, for example, by welding, is indicated schematically. Arch segment 24 comprises on its free end, which ends approximately under the roof, an angled hook 27, which coincides with a second angled hook at the end of the arch segment 24 which is connected here in an overlapping region 25, and a further third arch segment which is indicated only by broken lines. The overlap 25 brings about a spacing between said angled hooks 27, as a result of which the tensioning according to the invention is possible here, for example by means of a lashing strap which cooperates with both angled hooks 27.

In addition, cable clamps, for example, can connect the two arch segments in the overlapping region 25 so as to be displaceable toward one another. Should the internal tension of the tensioned tensioning arch 4 or tensioning ring yield a little when the holding devices of the reinforcement carriage are moved back, the tensioning arch 4 or tensioning ring can be moved back into the correct position here as a result of increasing the internal tension by bringing the angled hooks 27 of the tensioning arch 4 or tensioning ring together. The cable clamps, for example, can then be tightened or welding performed.

FIG. 7 shows an entire mounted tensioning arch 4 with outer and inner reinforcement layers 19 and 20, the tensioning support bodies 2 and spacers 1 and 22, the dimensions of which are not shown more precisely. It is clear that a self-supporting reinforcement of the inner shell has been constructed here with minimum structural expenditure.

FIGS. 8 to 17 then show the most varied designs of spacers 1, primarily bar-shaped spacers 1 being shown. These have, as a rule, a continuous support surface 10 or two separate contact surfaces 10 which are connected by an arched or recessed central region 11. In the case of the last design, the contact surface 10 is reduced to two separate contact surfaces 10, which ensures it can stand safely on the substructure of the tunnel wall of the outer formwork and contributes to saving material in the case of the spacers 1.

Fastening means or receiving means 8, which are connected to the tensioning support body 2, are now arranged in the surface 12 of the spacer 1 which points to the tensioning arch 4 or tensioning ring. Said receiving means 8 are realized either in the form of bores 7 or, as already explained beforehand in the connection to the tensioning support bodies 2, as slot-like receiving means 13 or projections into which corresponding angulations 14 of the tensioning support bodies 2 can then be inserted and tensioned. Plastic or metal bodies can also be inserted into the spacer as fastening means.

It should be noted in this connection, in principle, that the realization of the spacers 1 can vary greatly as they function in different designs in their functionality and are always to be designed in their functional connection to the tensioning support bodies 2. The advantage of the bar-shaped design here is simultaneously supporting and defining the tension of the tensioning support bodies 2 as a result of establishing the spacing between the laterally turned out support arms 3 in an effective manner. As a result of multiple receiving means 8 which are located at different spacings from one another, it is also possible to adjust the tension of the tensioning support body 2 in the gap between tensioning arch 4 or tensioning ring and outer shell 15, depending on whether the support arms 3 engage in the spacer 1 closer to one another or further apart from one another. The tensioning support body 2 is shortened or lengthened as a result.

Figure 16:
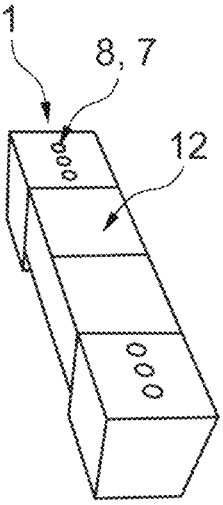
Figure 17:
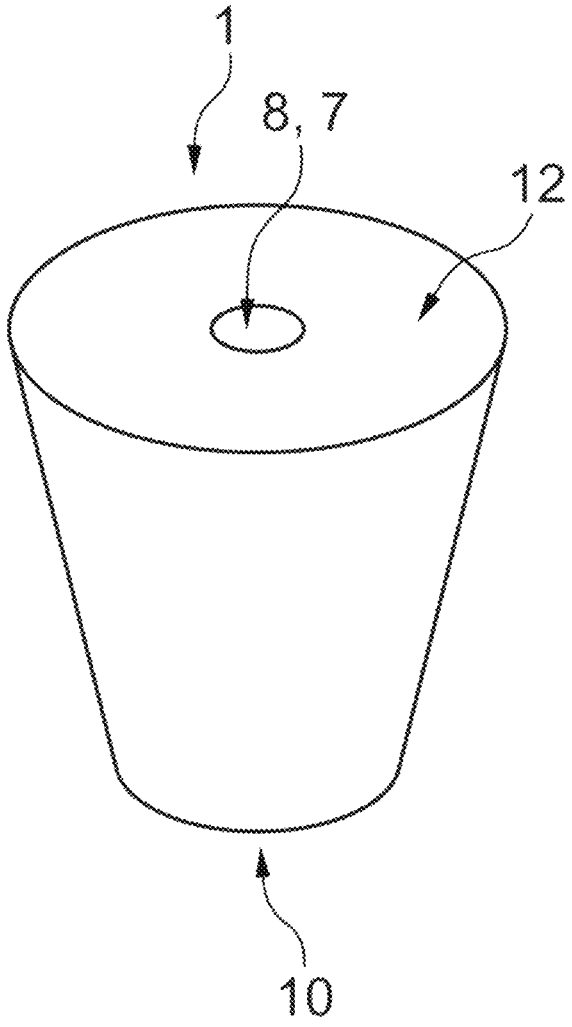

Along with the rod-shaped or bar-shaped realization, a one-part realization in the sense of FIG. 16 is also possible which then communicates just with a free end 9 of the tensioning support body 2. This means that the spacer body 1 is placed directly onto the free end 9 of the tensioning support body 2 here, as a result of which, as a rule, two of said spacers are to be connected here to the support arms 3 of a tensioning support body 2.

Designs of the reinforcement system according to the invention are to be explained in more detail below. In principle, an advantage of the reinforcement system according to the invention is that the tensioning arches or tensioning rings, which serve as support for the reinforcement steel meshes to be subsequently installed, are held in a significantly simpler manner than the load-bearing arches installed in a standard manner in the prior art. The tensioning arches or tensioning rings consist, in this connection, of reinforcement bars which are installed, for example, as round rods. As an alternative to this, cross sections other than the round rod are also possible, as first and foremost it is a question of a structurally expensive solution such as the load-bearing arch not being used here but rather a simple reinforcement rod.

The question of the design of the tensioning support body allows for various structural solutions here which are now to be discussed in more detail. In this connection, in each case the structural solution described below is to be disclosed in combination with the designs of the tensioning arches or tensioning rings described beforehand as a combination, insofar as, for example, the various alternative cross sections of the tensioning arches or tensioning rings or the connection thereof produced from segments are concerned.

A basic design of the reinforcement according to the invention provides, for example, a tensioning arch or tensioning ring in the form described beforehand which is able to engage in an approximately M-shaped tensioning support body. It engages, in this connection, in the indentation approximately in the center of the M-shaped tensioning support body. Therefore, said tensioning support body brings about the spacing and the tensioning as well as the support on the outer shell of the tunnel construction by means of two lengthened lateral support arms.

The achievement of the M-shaped arrangement is that the laterally branching support arms ensure that lateral tilting of the tensioned tensioning arch or tensioning ring is not possible on account of its progression being arranged at an angle to the outer shell. There are various options then as to how the connection to the outer shell of the tunnel construction can be effected for the design of the approximately M-shaped tensioning support body.

An advantageous design provides that the tensioning support body engages in standing regions in the form of spacers which can consist, for example, of cast or extruded concrete but in principle can also be, for example, plastic bodies. Said spacers can either be assigned individually to the support arms or, however, can exist in the form of an approximately bar-shaped spacer in which both free ends engage, bores or slot-shaped receiving means being possible here in the spacers.

As an alternative to this, it is also possible to arrange simplified standing regions on the free ends of the tensioning support body, for example supporting feet which can be produced, for example, from plastics material. In addition, there is the option to arrange the support region even integrally on the tensioning support body so that it is not to be positioned as a separate body but is already arranged thereon during the tensioning of the tensioning support body.

Along with the design of the approximately M-shaped tensioning support body described beforehand, it is also provided in a design as an alternative to this to design a tensioning support body from only one support arm which cooperates with the tensioning arch or tensioning ring via a corresponding terminal receiving element. Securing said tensioning support body against tilting of the load-bearing arch during tensioning of the same is to be achieved, in this connection, in an inventive manner, which is why the support region is to be realized here in a corresponding tilt-safe manner on the outer shell of the tunnel construction.

A structural solution is provided, for example, in this connection, where an approximately trapezoidal spacer or support region is provided for receiving the free end of the tensioning support body, the tensioning support body being inserted into a bore of said spacer. A wide support surface on the outer shell of the tunnel construction ensures that said tensioning support body cannot tilt.

Further structural designs for protecting the tensioning support body which consist of one support arm which, for example, consist of a support region which consists of a branching support region which consists of multiple extension arms and can be supported on the outer shell of the tunnel, or also of a type of flat plate with which the support arm of the tensioning support body cooperates, are intended in principle, in this context.

It is consequently clear that the design of the tensioning support body can be effected, in principle, in various ways insofar as secure protection is achieved against tilting of the tensioning support body when the tensioning arch or tensioning ring is tensioned. The tensioning support body must safely ensure the task of both tensioning and securely supporting the load-bearing arch.

The invention claimed is:

1. A self-supporting reinforcement system for a concrete lining of an inner shell of a tunnel construction, the reinforcement system comprising:

tensioning arches or tensioning rings with an adaptable arch length or an adaptable ring circumference, the tensioning arches or tensioning rings each including at least two arch segments defining a tunnel reinforcement arch or tunnel reinforcement ring for reinforcement of the inner shell of the tunnel construction for support for at least one outer layer of reinforcement steel meshes, wherein the arch segments are each formed from an individual reinforcement steel rod, and the individual reinforcement steel rod is configured to be directly disposed against the outer layer of the reinforcement steel meshes, tensioning support bodies each having a connecting region configured to receive the tensioning arches or tensioning rings, and at least one support arm, for tensioning the tensioning arches or tensioning rings on an outer shell or rock face wall of the tunnel construction in a supporting manner and producing a spacing with respect to the outer shell or to the rock face wall, first spacers on the tensioning support bodies for support on the outer shell or rock face wall of the tunnel construction and for generating a minimum concrete coverage of installed reinforced concrete parts, and second spacers between the outer layer and an inner layer of the reinforcement steel meshes, wherein the tensioning arches or tensioning rings are configured to be expanded and tensioned against the tensioning support bodies to apply a force to the first spacers against the outer shell or rock face wall of the tunnel construction.

2. The self-supporting reinforcement system for the concrete lining of the inner shell of a tunnel construction as claimed in claim 1, wherein at least two arch segments of the tensioning arches or tensioning rings are connected together by a releasable connecting element for adapting the arch length or the ring circumference.

3. The self-supporting reinforcement system for the concrete lining of the inner shell of a tunnel construction-as claimed in claim 2, wherein for adapting the arch length or the ring circumference, at least two arch segments of the tensioning arches or tensioning rings comprise overlapping regions which are releasably connected together by a cable clamp.

4. The self-supporting reinforcement system for the concrete lining of the inner shell of a tunnel construction as claimed in claim 2, wherein for adapting the arch length or the ring circumference, at least two arch segments of the tensioning arches or tensioning rings comprise angled free ends as angled hooks or cooperation points at which a tensioning device is able to be placed.

5. The self-supporting reinforcement system for the concrete lining of the inner shell of a tunnel construction as claimed in claim 1, wherein for adapting the arch length or the ring circumference, at least two arch segments of the tensioning arches or tensioning rings are connected together by a length-adjustable intermediate piece or connecting element.

6. The self-supporting reinforcement system for the concrete lining of the inner shell of a tunnel construction as claimed in claim 1, wherein the arch segments of the tensioning arches or tensioning rings are realized as reinforced steel rods with a round, oval or rectangular cross section which comprise a diameter or a diagonal of approximately between 15 mm and 50 mm.

7. The self-supporting reinforcement system for the concrete lining of the inner shell of a tunnel construction as claimed in claim 1, wherein the tensioning support bodies are distributed approximately uniformly over the tensioning arches or tensioning rings, which are composed of the arch segments, and are arranged thereon.

8. The self-supporting reinforcement system for the concrete lining of the inner shell of a tunnel construction as claimed in claim 1, wherein the tensioning support bodies are realized in an approximately M-shaped manner, wherein the connecting region is arranged in the centrally arranged, approximately V-shaped recess between the support arms of the tensioning support bodies for receiving the tensioning arch or tensioning ring.

9. The self-supporting reinforcement system for the concrete lining of the inner shell of a tunnel construction as claimed in claim 1, wherein the tensioning support bodies comprise a connecting region for receiving the tensioning arch or tensioning ring in the form of a fastener to the tensioning arch, from which branches the at least one support arm of the tensioning support body.

10. The self-supporting reinforcement system for the concrete lining of the inner shell of a tunnel construction as claimed in claim 1, wherein a single elongated spacer of the first spacers is provided for receiving free ends of the support arms of the tensioning support body and for support on the outer shell of the tunnel construction or the rock face wall, and the single elongated spacer comprises, on its top side facing the tensioning arch and the tensioning support body, a receiver for receiving the free ends of the support arms which are realized as slot-like indentations, bores, projections or inserted connectors.

11. The self-supporting reinforcement system for the concrete lining of the inner shell of a tunnel construction as claimed in claim 10, wherein the single elongated spacer is a bar-shaped spacer including, on its bottom-side contact surface, a central region which is realized in a recessed manner compared to contact surfaces which are arranged peripherally.

12. The self-supporting reinforcement system for the concrete lining of the inner shell of a tunnel construction as claimed in claim 1, wherein one single spacer of the first spacers or foot is arranged on each of free ends of the support arms of the tensioning support body.

13. The self-supporting reinforcement system for the concrete lining of the inner shell of a tunnel construction as claimed in claim 1, wherein the first spacers are coated on their rear contact surface with a protective damage-preventing support.

14. A method for installing the self-supporting reinforcement system as claimed in claim 1, wherein tensioning arches or tensioning rings produced from the arch segments are preformed and mounted such that, in their position and basic form in a tunnel cross section, the tensioning arches or tensioning rings form a support for a defined installation position of the outer layer of the reinforcement steel meshes, said tensioning arches or tensioning rings, guided on a reinforcement carriage, are placed or held and aligned in the tunnel cross section, a distance from the tensioning arch or tensioning ring to the outer layer or rock face wall is measured in a punctiform manner at circumferentially defined cooperation points of the tensioning support bodies and each tensioning support body to be inserted is shortened on site by trimming or angling to a measurement which is determined in such a manner, first spacers and tensioning support bodies, which have been adapted in length, are arranged in a clamped manner between the outer shell of the tunnel construction or the rock face wall and the tensioning arches and are distributed over the entire circumference thereof, as a result, the tensioning arches or tensioning rings are tensioned and expanded to apply a force to the first spacers against the outer shell of the tunnel construction or the rock face wall via the tensioning support bodies, and subsequently the tensioning arches or tensioning rings are fixed themselves.

15. The method for installing a reinforcement system as claimed in claim 14, wherein the arch segments are mounted at least in part by a releasable connection to form the tensioning arches or tensioning rings, wherein said releasable connection between at least two of the arch segments is released prior to a final expansion of the tensioning arches or tensioning rings and is fixed again after the expansion.

16. The method for installing a reinforcement system as claimed in claim 14, wherein length-adjustable intermediate pieces are inserted between at least two of the arch segments, wherein said intermediate pieces are lengthened for a subsequent expansion of the tensioning arches or tensioning rings and are fixed again after the expansion.

17. The method for installing a reinforcement system as claimed in claim 14, wherein the tensioning arches are set up as support on a precast concrete floor of the tunnel construction or in holes which are arranged in said precast concreted floor.

18. The method for installing a reinforcement system as claimed in claim 14, wherein after the tensioning by the tensioning support bodies, the tensioning arches or tensioning rings are fastened by a fastener or a welded connection in a connecting region of the tensioning support bodies.

19. The method for installing a reinforcement system as claimed in claim 14, wherein the tensioning arches or tensioning rings are installed in parallel in pairs and are connected fixedly by cross-connectors.

20. The method for installing a reinforcement system as claimed in claim 14, wherein a tensioning device is positioned on two adjacent arch segments for a final expansion of the tensioning arches or tensioning rings, a connection between said arch segments is then released and is fixed again by the tensioning device after the expansion.

* * * * *